US009833791B2

(12) United States Patent
Wang et al.

(10) Patent No.: US 9,833,791 B2
(45) Date of Patent: Dec. 5, 2017

(54) MAGNETIC SEPARATOR FOR IMPROVING GRADE OF REFINED ORE AND REDUCING SLAGS

(71) Applicant: SHANDONG HUATE MAGNET TECHNOLOGY CO., LTD, Shandong (CN)

(72) Inventors: Shun Wang, Shandong (CN); Zhaolian Wang, Shandong (CN); Fengliang Liu, Shandong (CN); Yuyong Li, Shandong (CN); Liangman Zhang, Shandong (CN); Yi Zhao, Shandong (CN)

(73) Assignee: SHANGDONG HUATE MAGNET TECHNOLOGY CO., LTD, Shandong (CN)

( * ) Notice: Subject to any disclaimer, the term of this patent is extended or adjusted under 35 U.S.C. 154(b) by 0 days.

(21) Appl. No.: 15/026,124

(22) PCT Filed: Jan. 13, 2015

(86) PCT No.: PCT/CN2015/070589

§ 371 (c)(1),
(2) Date: Mar. 30, 2016

(87) PCT Pub. No.: WO2015/109962

PCT Pub. Date: Jul. 30, 2015

(65) Prior Publication Data

US 2016/0318036 A1 Nov. 3, 2016

(30) Foreign Application Priority Data

Jan. 25, 2014 (CN) ..... 2014 1 0036271

(51) Int. Cl.

| | |
|---|---|
| ***B03C 1/14*** | (2006.01) |
| ***B03C 1/033*** | (2006.01) |
| ***B03C 1/034*** | (2006.01) |

(52) U.S. Cl.
CPC ..... *B03C 1/145* (2013.01); *B03C 1/034* (2013.01); *B03C 1/0332* (2013.01)

(58) Field of Classification Search
CPC ..... B03C 1/14; B03C 1/145; B03C 2201/18; B03C 2201/20; B03C 2201/22
See application file for complete search history.

(56) References Cited

U.S. PATENT DOCUMENTS 3,489,280 A * 1/1970 Merwin ..... B03C 1/14 209/223.1
3,856,666 A 12/1974 Yashima et al.
(Continued)

FOREIGN PATENT DOCUMENTS

CN 2059603 U 7/1990
CN 2189488 Y 2/1995
(Continued)

OTHER PUBLICATIONS

Chinese Office Action dated Jul. 17, 2015 for Chinese application No. 201410036271.2.
(Continued)

*Primary Examiner* — Joseph C Rodriguez
(74) *Attorney, Agent, or Firm* — Ohlandt, Greeley, Ruggiero & Perle, LLP

(57) ABSTRACT

A magnetic separator comprising a concurrent tank body and a permanently magnetic barrel, wherein the rotation direction of the permanently magnetic barrel is opposite to the inlet direction of the ore slurry; a stationary magnetic system is provided; the inlet side of the tank body is connected to a tubular ore-feeding box; the included angle of the magnetic system is in the range of 200°-280°; the region of the magnetic system closer to the inlet side of the tank body is a refining region of the magnetic system; at an upstream position in the tank body, a plurality of rinsing water pipes are provided; several spraying nozzles are provided at
(Continued)

intervals on the rinsing water pipes; and several stripe-shaped magnetically conductive thin sheets are provided at intervals on an inner wall of the permanently magnetic barrel.

6 Claims, 4 Drawing Sheets

(56) References Cited

U.S. PATENT DOCUMENTS

| | | | | |
|---|---|---|---|---|
| 4,359,382 | A * | 11/1982 | Morgan | B03C 1/14 209/223.2 |
| 8,807,344 | B2 * | 8/2014 | Keaton | B03C 1/0332 209/214 |
| 9,375,727 | B2 * | 6/2016 | Molteni | B03C 1/14 |
| 2013/0043167 | A1 | 2/2013 | Han et al. | |
| 2014/0083920 | A1 * | 3/2014 | Nishizawa | B03C 1/0332 210/223 |
| 2015/0298138 | A1 * | 10/2015 | Vareika | B03C 1/14 210/222 |
| 2016/0030947 | A1 * | 2/2016 | Van Zyl | B03C 1/14 210/695 |

FOREIGN PATENT DOCUMENTS

| | | | |
|---|---|---|---|
| CN | 2323874 | Y | 6/1999 |
| CN | 2702780 | Y | 6/2005 |
| CN | 2907902 | Y | 6/2007 |
| CN | 101077485 | A | 11/2007 |
| CN | 201001848 | Y | 7/2008 |
| CN | 201208575 | Y | 3/2009 |
| CN | 201423311 | Y | 3/2010 |
| CN | 202983881 | U | 6/2013 |
| CN | 103785528 | A | 5/2014 |
| CN | 203711132 | U | 7/2014 |
| DE | 1257701 | B | 1/1968 |
| GB | 1224449 | | 3/1971 |
| RU | 1808386 | A1 | 4/1993 |
| RU | 10123 | U1 | 6/1999 |
| RU | 2460584 | C1 | 9/2012 |
| RU | 134453 | U1 | 11/2013 |
| SU | 1143467 | A1 | 3/1985 |
| SU | 1357077 | A1 | 12/1987 |
| SU | 1641428 | A1 | 4/1991 |
| WO | 2009/153980 | A1 | 12/2009 |

OTHER PUBLICATIONS

International Search Report dated Mar. 17, 2015 from International Application No. PCT/CN2015/070589, 14 pages.

Written Opinion dated Mar. 17, 2015 from International Application No. PCT/CN2015/070589, 5 pages.

Russian Office Action dated Apr. 20, 2017 for Russian application No. 2016116818.

Russian Office Action dated Aug. 2, 2017 for Russian application No. 2016116818.

European Search Report dated Aug. 10, 2017 for European application No. 15739991.6.

* cited by examiner

MAGNETIC SEPARATOR FOR IMPROVING GRADE OF REFINED ORE AND REDUCING SLAGS

CROSS-REFERENCED APPLICATIONS

This application is a National Phase entry of PCT Application No. PCT/CN2015/070589, filed Jan. 13, 2015, which application claims the benefit of priority to Chinese Patent Application No. 201410036271.2 titled "CONCENTRATE EXTRACTING AND SLAG REDUCING MAGNETIC SEPARATOR", filed with the Chinese State Intellectual Property Office on Jan. 25, 2014, the entire disclosures of which are incorporated herein by reference.

BACKGROUND

1. Field of the Disclosure

The present application relates to the technical field of ore dressing devices, and particularly to a concentrate extracting and slag reducing magnetic separator.

2. Discussion of the Background Art

With the exploitation and utilization of ore resources, not only a large quantity of ore can only be used after being performed with ore dressing, but also more and more refractory ore in the separated ore is present, further, smelting has forwarded stricter requirement for the quality of a concentrate. Therefore, how to use a method as simple as possible to improve a grade of concentrate in the ore dressing process is an important issue for ore dressing workers to be addressed.

A magnetic separator for mineral concentration is a magnetic separation device used for improving the grade and a concentration of the concentrate, which has developed with the developing of ore dressing technology in recent years. The operating principle thereof is that the separation of the ore is realized by virtue of the action on ore grains applied by a magnetic force and a mechanical force. Separable ore species include various kinds of magnetite, hematite, limonite, manganese ore, etc. Currently, separation devices for mineral concentration, commonly adopted by various dressing plants, are mainly some magnetogravity type devices such as a magnetic deslimer or an electromagnetic elutriation magnetic separator, however, such type of device has the disadvantages of, firstly, a large volume is, a complex structure, and an inconvenient mounting, secondly, a large water consumption, thirdly, a complicated control system, and an unstable ore dressing index, fourthly, a requirement for feeding ore with a low concentration, and a low processing capacity per machine-hour. Due to the disadvantages of a conventional device, production efficiency and economic benefit of the dressing plant are strictly restricted.

SUMMARY

A technical issue to be addressed by the present application is to provide a concentrate extracting and slag reducing magnetic separator to replace a conventional concentration device, and the concentrate extracting and slag reducing magnetic separator according to the present application may significantly improve a grade of ore product, and the separated concentrate may have a high concentration.

For addressing the above technical issue, the technical solutions provided by the present application are that: a concentrate extracting and slag reducing magnetic separator includes a tank fixedly arranged on a frame, a permanent magnetic drum powered by a power unit is rotationally provided in the tank, a magnetic system fixed with respect to the tank is provided in the permanent magnetic drum, an ore entering side of the tank is connected to an ore feeding box; a coverage angle of the magnetic system ranges from 200 degrees to 280 degrees, the magnetic system is of a multi-magnetic pole structure, an area of the magnetic system close to the ore entering side of the tank is a magnetic system concentration area, and the magnetic system concentration area is located above an ore pulp level in the tank, multiple rinsing water pipes are provided in an upstream position, corresponding to the magnetic system concentration area, in the tank, the multiple rinsing water pipes are arranged at outer side of the permanent magnetic drum and are located above the ore pulp level in the tank, multiple spray heads facing to the permanent magnetic drum are provided with intervals on each of the rinsing water pipes, and the spray heads on adjacent rinsing water pipes are staggered, and multiple strip-type magnetic sheets are provided with interval on an inner wall of the permanent magnetic drum, and each of the magnetic sheets has an extending direction consistent with an axial direction of the permanent magnetic drum.

Further, multiple rinsing water pipes are concentrically arranged with respect to the permanent magnetic drum.

Further, the ore feeding box is a pipe type ore feeding box, the pipe type ore feeding box includes a pipe body having two closed ends arranged at the ore entering side of the tank, at least one ore feeding port is provided at a top portion of the pipe body, an ore drawing slot is provided at a bottom of the pipe body, an extending direction of the ore drawing slot is consistent with the axial direction of the permanent magnetic drum, a width of a portion, corresponding to the ore feeding port, of the ore drawing slot is slightly less than or equal to widths of other portions of the ore drawing slot.

Further, two layers of unloading scraping boards are provided at an upper position and a lower position of an ore unloading side of the concentrate extracting and slag reducing magnetic separator.

Due to the above technical solutions, after the concentrate extracting and slag reducing magnetic separator according to the present application adopts the magnetic system of a large coverage angle, a concentration area of the concentrate extracting and slag reducing magnetic separator and a conveying area of ore are lengthened, further, the multi-magnetic pole structure employed by the magnetic system allows magnetic tumbling times of the ore to be increased, thus not only helps improve a grade of the concentrate, but also allows mineral and water to be better separated in a long ore conveying process, thereby better realizing concentration of the mineral. Since multiple rinsing water pipes are centripetally arranged with respect to the permanent magnetic drum, the mineral is allowed to be rinsed and concentrated in a long magnetic system concentration area after the mineral separating from the ore pulp level, thus removing impurities and improving the concentrate grade, therefore, the selection effect is significantly improved compared with a traditional concentrator. And since all of the rinsing water pipes are located above the ore pulp level, there is no possibility that the rinsing water pipes are blocked by the mineral compared with a traditional rinsing water pipe. The spray heads on adjacent rinsing water pipes are staggered, which allows a more thorough rinsing, leaving no dead angle. Since multiple strip-type magnetic sheets are provided on the inner wall of the permanent magnetic drum, in the rotating process of the permanent magnetic drum, a magnetic shielding is constantly formed between the magnetic sheets and the magnetic poles, thus generating a disturbed magnetic field on a surface of the permanent magnetic drum. The mineral constantly presents motion states of gathering, scattering, and then gathering in the separation process, additionally with the rinsing water sprayed out by the multiple rinsing water pipes, thus the impurities in the minerals can be be thoroughly separated out, which further improves the concentrate grade.

The pipe type ore feeding box and, the ore drawing slot consistent with an axial direction of the permanent magnetic drum provided at the bottom of the pipe body, may ensure that the ore pulp entering the concentrate extracting and slag reducing magnetic separator to be separated is uniformly distributed in an axial direction of the permanent magnetic drum. In the case that a width of a portion, corresponding to the ore feeding port, of the ore drawing slot is slightly less than widths of other portions of the ore drawing slot, flowing velocities of the ore pulp at different sections are easy to be adjusted, and the ore drawing slot allows the ore drawing flow velocities to be consistent in the length direction of the whole ore drawing slot, which facilitates the uniformity of the ore dressing, thereby improving the final concentrate grade.

In the case that two layers of unloading scraping boards are provided at an upper position and a lower position of an ore unloading side of the concentrate extracting and slag reducing magnetic separator, a complete unloading is ensured, the tailings are reduced, and a concentrate concentration is improved.

It may be concluded from above that, the concentrate extracting and slag reducing magnetic separator according to the present application may significantly improve the grade of the ore products, thus the separated concentrate has a high concentration, and the concentrate extracting and slag reducing magnetic separator has a compact structure, a small volume, a large processing capacity per machine hour, and a high production efficiency, thus may improve the economic benefit of the dressing plant.

BRIEF DESCRIPTION OF THE DRAWINGS

In order to illustrate the technical solutions in the embodiments of the present application or the conventional art more clearly, the accompanying drawings required by describing the embodiments or conventional art will be illustrated briefly below. Apparently, the accompanying drawings described below are only a few of embodiments of the present application, and for those skilled in the art, other companying drawings will be obtained according to those companying drawings without any creative work.

Figure 1:
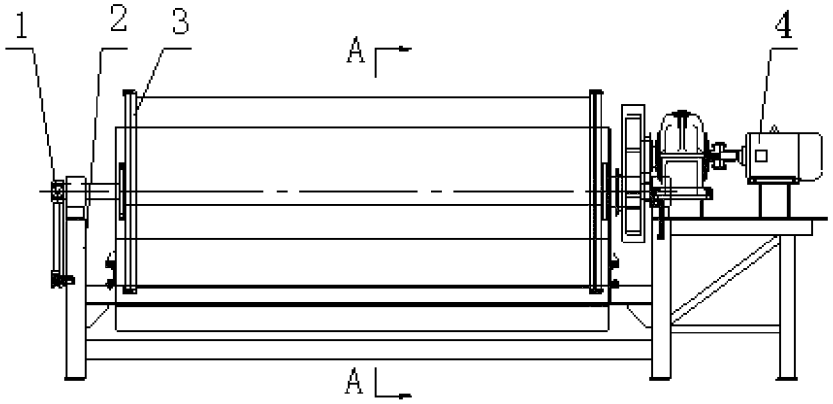
FIG. 1 is a schematic view showing the structure of a concentrate extracting and slag reducing magnetic separator according to the present application.

Reference numerals in FIGS. 1 to 9:

| | | | |
|---|---|---|---|
| 1 | magnetic system adjusting device, | 2 | frame, |
| 3 | permanent magnetic drum, | 4 | power unit, |
| 5 | flushing device, | 6 | tank, |
| 7 | magnetic system concentration area, | 8 | magnetic system, |
| 9 | tailing outlet, | | |
| 10 | primary unloading scraping board, | | |
| 11 | secondary unloading scraping board, | 12 | concentrate collecting box, |
| 13 | ore feeding port, | 14 | overflow baffle, |
| 15 | rinsing water pipe, | 151 | spray head, |
| 16 | pipe type ore feeding box, | 17a | ore drawing slot, |
| 17b | ore drawing slot, | 18 | supporting base, |
| 19 | drum body, | 20 | main shaft, |
| 21 | slewing bearing, | 22 | transmission gear, |
| 23 | magnetic sheet. | | |

DETAILED DESCRIPTION OF THE PREFERRED EMBODIMENT

For more clearly illustrating the objects, the technical solutions and the advantages of the present application, the present application is further described in detail in conjunction with drawings and embodiments hereinafter. It should be understood that, the embodiments described are only for interpretation of the present application, rather than for limiting the present application.

Figure 2:
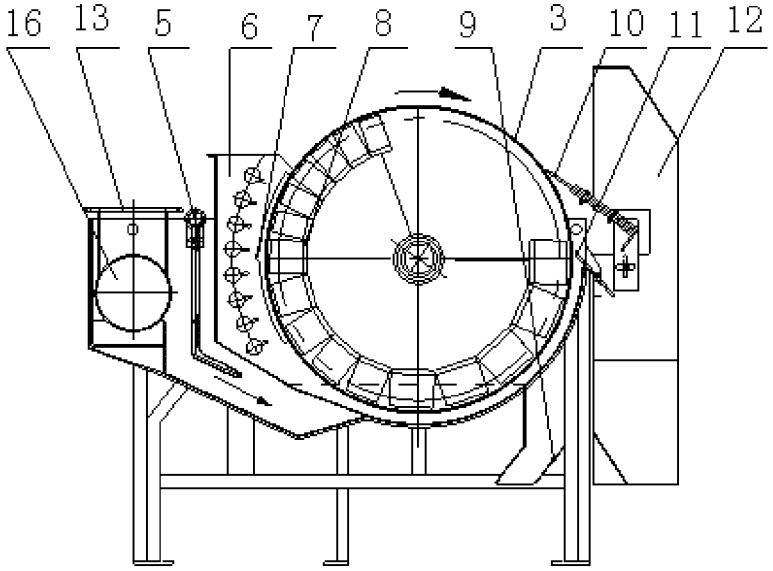
FIG. 2 is a sectional schematic view taken along the A-A direction in FIG. 1.
Figure 7:
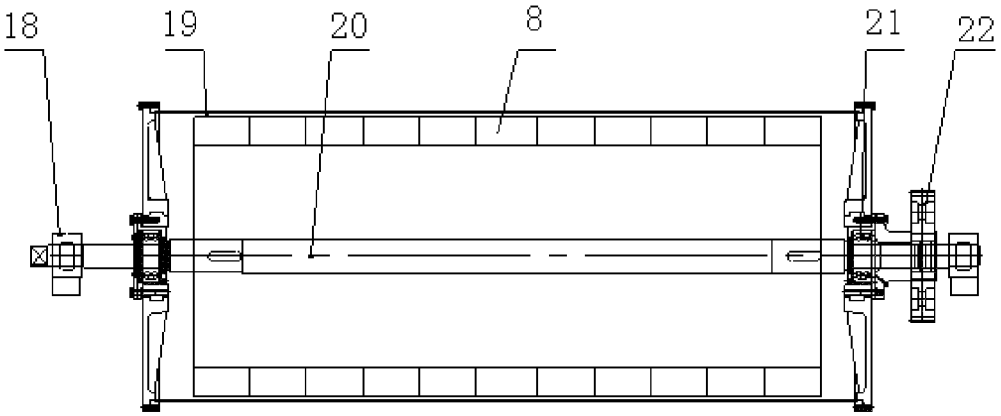
FIG. 7 is a schematic view showing the structure of a permanent magnetic drum of the concentrate extracting and slag reducing magnetic separator according to the present application.

As shown in FIGS. 1 and 2, a concentrate extracting and slag reducing magnetic separator according to the present application includes a concurrent flow tank 6 fixedly arranged on a frame 2. A concentrate collecting box 12 is provided at an ore-drawing side of the concurrent flow tank 6. A tailings outlet 9 is provided at a bottom of the concurrent flow tank 6. A permanent magnetic drum 3 powered by a power unit 4 is rotationally provided in the concurrent flow tank 6. A lower half of the permanent magnetic drum 3 is located in the concurrent flow tank 6, and the power unit 4 for rotating the permanent magnetic drum 3 is a conventional technology in the art. As shown in FIG. 7, a main shaft 20 in the permanent magnetic drum 3 is supported on a supporting base 18, and the power unit 4 includes an electric motor and a gearbox. A gear is mounted at an output end of the gearbox, which is engaged with a transmission gear 22 mounted at an end portion of the main shaft 20, and the permanent magnetic drum 3 is rotated by the power unit 4 via a slewing bearing 21 in a direction indicated by an arrow in FIG. 2, and the rotation direction of the permanent magnetic drum 3 is opposite to an ore pulp entering direction of ore pulp. A magnetic system 8 fixed with respect to the concurrent flow tank 6 is provided in the permanent magnetic drum 3, a magnetic system adjusting device 1 for adjusting the magnetic system 8 is provided at an outer side of the concentrate extracting and slag reducing magnetic separator, and the magnetic system adjusting device 1 is a conventional technology in the prior art, the structure and principle of which therefore are not described in detail. An ore entering side of the concurrent flow tank 6 is connected to an ore-feeding box.

As shown in FIG. 2, the magnetic system 8 is of a multi-magnetic pole structure. The number of the magnetic poles preferably ranges from 16 to 65, and a coverage angle of the magnetic system 8 ranges from 200 degrees to 280 degrees. An area of the magnetic system 8, where the magnetic system 8 is close to the ore entering side of the concurrent flow tank 6, is set as a magnetic system concentration area 7, and the magnetic system concentration area 7 is located above an ore pulp level in the concurrent flow tank 6 (indicated by a horizontal dotted line at a bottom of the concurrent flow tank). The magnetic system with a large coverage angle allows a concentration area of the concentrate extracting and slag reducing magnetic separator and a conveying area of ore to be lengthened. Further, the multi-magnetic pole structure employed by the magnetic system 8 allows magnetic tumbling times of the ore to be increased, which thus not only helps improve a grade of concentrate, but also allows mineral and water to be better separated in a long ore conveying process, thereby better realizing the concentration of the mineral.

Figure 3:
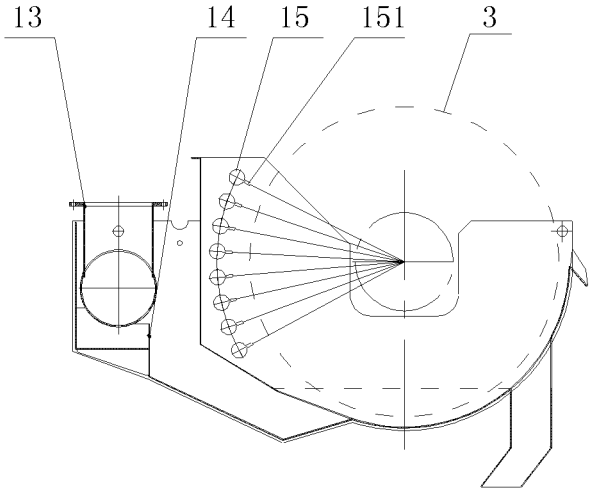
FIG. 3 is a schematic view showing the structure of a tank of the concentrate extracting and slag reducing magnetic separator according to the present application.

As shown in FIG. 3, a portion, corresponding to the magnetic system concentration area 7, at an upstream position in the concurrent flow tank 6 is provided with multiple rinsing water pipes 15. The multiple rinsing water pipes 15 are arranged at an outer side of the permanent magnetic drum 3 and located above the ore pulp level in the concurrent flow tank 6. Multiple spray heads 151 facing to the permanent magnetic drum 3 are arranged with intervals on each of the rinsing water pipes 15, and the spray heads 151 on adjacent rinsing water pipes 15 are staggered. The multiple rinsing water pipes 15 are preferably concentrically arranged with respect to the permanent magnetic drum 3. In the magnetic system concentration area 7, multiple rinsing water pipes 15 centripetally arranged with respect to the permanent magnetic drum 3 allow the mineral from the ore pulp level to be rinsed and concentrated in a long magnetic system concentration area, which removes impurities and improves the concentrate grade. Therefore, the selection effect is significantly improved compared with a traditional concentrator. Further, since all of the rinsing water pipes 15 are located above the ore pulp level, there is no possibility that the rinsing water pipes 15 are blocked by the mineral when being compared with a traditional rinsing water pipe. The spray heads 151 on adjacent rinsing water pipes 15 are staggered, which allows the rinsing to be more thoroughly, leaving no dead angle.

Figure 8:
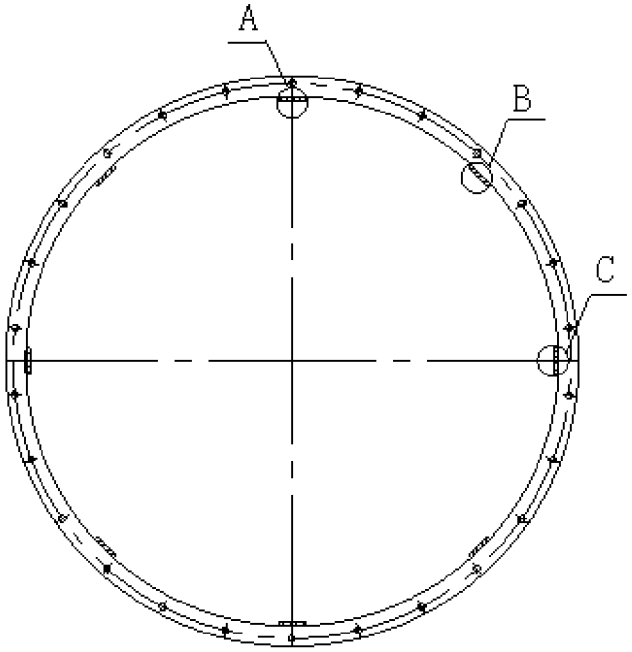
FIG. 8 is an enlarged schematic view showing where magnetic sheets are internally provided on the permanent magnetic drum.
Figure 9:
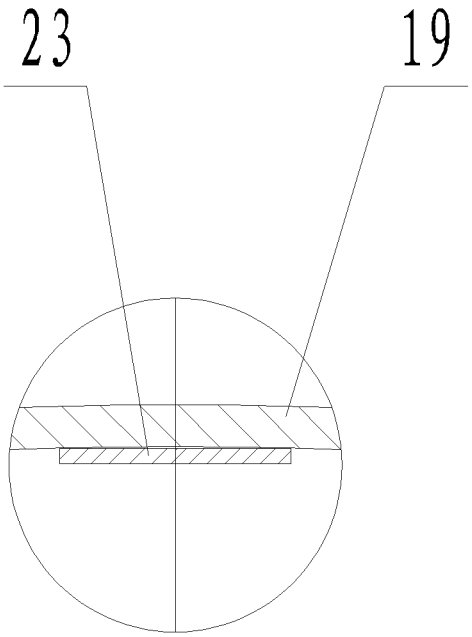
FIG. 9 is an enlarged schematic view showing a portion A, a portion B, or a portion C in FIG. 8.

As shown in FIGS. 8 and 9, multiple strip-type magnetic sheets 23 are arranged with intervals on an inner wall of a drum body 19 of the permanent magnetic drum 3. The magnetic sheets 23 may employ magnetic sheets made of stainless steel, and the number of the magnetic sheets 23 may be increased or decreased according to practical conditions. In the rotating process of the permanent magnetic drum 3, magnetic shielding is constantly formed between the magnetic sheets 23 and the magnetic poles, thus generating a disturbed magnetic field on a surface of the permanent magnetic drum 3. The mineral constantly presents motion states of gathering, scattering, and then gathering in the separation process, additionally with the rinsing water sprayed out by the multiple rinsing water pipes 15, which allows the impurities in the minerals to be thoroughly separated out, further improving the concentrate grade.

Multiple improvements further made to the above embodiment are described hereinafter.

The ore feeding box is a pipe type feeding box 16, which includes a pipe body with two closed ends arranged at the ore entering side of the concurrent flow tank 6. At least one ore feeding port 13 is provided at a top portion of the pipe body, and an ore drawing slot is provided at a bottom of the pipe body. An extending direction of the ore drawing slot is coincident with an axis direction of the permanent magnetic drum 3.

Figure 4:
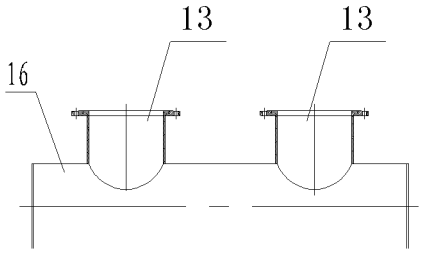
FIG. 4 is a schematic view showing the structure of an ore drawing slot of a pipe type ore feeding box of the concentrate extracting and slag reducing magnetic separator according to the present application.
Figure 5:
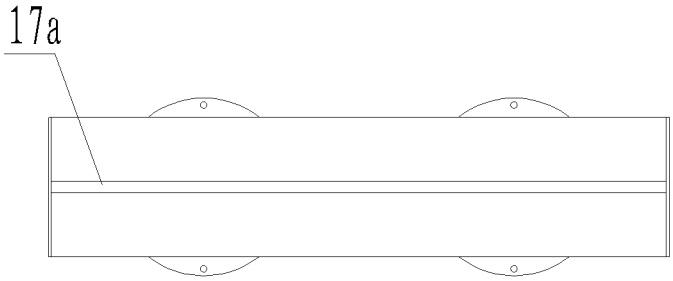
FIG. 5 is a schematic view showing one structure of the ore drawing slot of the pipe type ore feeding box in FIG. 4 (a bottom view of FIG. 4)
Figure 6:
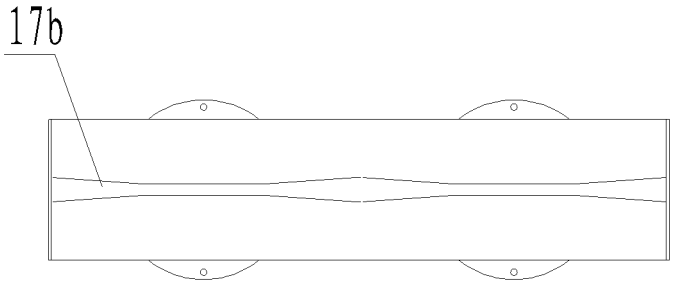
FIG. 6 is a schematic view showing another structure of the ore drawing slot of the pipe type ore feeding box in FIG. 4.

As shown in FIG. 4, two ore feeding ports 13 are provided at the top portion of the pipe body, and the number of the ore feeding ports may be increased or decreased according to practical conditions. As shown in FIG. 5, the ore drawing slot 17*a* has a consistent width in a length direction of the whole ore drawing slot. As shown in FIG. 6, the ore drawing slot may also be preferably designed in a way that: a width of a portion, corresponding to the ore feeding port 13, of the ore drawing slot 17*b* is slightly less than widths of other portions of the ore drawing slot. The widths of the ore drawing slot 17*b* are not the same in the length direction of the whole ore drawing slot. Such a design has the advantages that: the ore pulp is added into the pipe body via the ore feeding port 13, and a flow velocity of the ore pulp at the portion of the ore drawing slot corresponding to the ore feeding port 13 is slightly greater than flow velocities of the ore pulp at the other portions of the ore drawing slot. The structure of the ore drawing slot 17*b* may allow the ore drawing slot 17*b* to have the ore drawing flow velocities consistent in the length direction of the whole ore drawing slot 17*b*, which facilitates the uniformity of the ore dressing, improving the final concentrate grade.

As shown in FIG. 3, an overflow baffle 14 is vertically provided at a position, corresponding to the pipe type ore feeding box 16, at a bottom portion in the concurrent flow tank 6. The overflow baffle 14 is located at a position downstream of the ore drawing slot and extends in a direction consistent with the extending direction of the ore drawing slot. The ore pulp is blocked by the overflow baffle 14 after flowing out via the ore drawing slot at the bottom of the pipe body. The combined application of such an ore feeding manner may ensure that the ore pulp entering the concentrate extracting and slag reducing magnetic separator to be separated is uniformly distributed in an axial direction of the permanent magnetic drum 3.

As shown in FIG. 2, a flushing device 5 is provided behind the overflow baffle 14 in the concurrent flow tank 6. The flushing device 5 employs a flushing pipe for the mineral, which adjusts the concentration of the ore pulp before the ore pulp being separated, and broadens the scope of the concentration of mineral that can be feed.

As shown in FIG. 2, two layers of unloading scraping boards are provided at an upper position and a lower position of an ore unloading side of the concentrate extracting and slag reducing magnetic separator, that is, a primary unloading scraping board 10 at an upper portion and a secondary unloading scraping board 11 at a lower portion. The primary unloading scraping board 10 is fixedly mounted on the concentrate collecting box 12, and the secondary unloading scraping board 11 is mounted on the frame. The arrangement of two layers of unloading scraping boards may ensure a complete unloading, reduce the tailings, and improve a concentrate concentration.

It may be concluded from the above description that, the concentrate extracting and slag reducing magnetic separator according to the present application may significantly improve the grade of the ore products, thus the separated concentrate has a high concentration. Further, the concentrate extracting and slag reducing magnetic separator has a compact structure, a small volume, a large processing capacity per machine hour, and a high production efficiency, which may improve the economic benefit of the dressing plant. The concentrate extracting and slag reducing magnetic separator according to the present application addresses the technical issues of the conventional magneto-gravity type concentrate device having a complicated structure, a large volume, a low concentrate grade, a complex control system, and a low product efficiency.

The embodiments described hereinabove are only preferred embodiments of the present application, and the part not described in details is general knowledge for those skilled in the art. The scope of the present application is defined by the claims, equivalent replacements and improvements made based on the technical teaching of the present application are also deemed to fall into the scope of the present application.

The invention claimed is:

1. A concentrate extracting and slag reducing magnetic separator, comprising a tank fixedly arranged on a frame, wherein a permanent magnetic drum powered by a power unit is rotationally provided in the tank, a rotation direction of the permanent magnetic drum is opposite to an ore pulp entering direction of ore pulp, a magnetic system fixed with respect to the tank is provided in the permanent magnetic drum, and ore entering side of the tank is connected to an ore feeding box, wherein:

a coverage angle of the magnetic system ranges from 200 degrees to 280 degrees, the magnetic system is of a multi-magnetic pole structure, an area of the magnetic system close to the ore entering side of the tank is a magnetic system concentration area, and the magnetic system concentration area is located above an ore pulp level in the tank;

a plurality of rinsing water pipes are provided in an upstream position, corresponding to the magnetic system concentration area, in the tank, the plurality of rinsing water pipes are arranged at an outer side of the permanent magnetic drum and are located above the ore pulp level in the tank, a plurality of spray heads facing to the permanent magnetic drum are provided with intervals on each of the rinsing water pipes, and the spray heads on adjacent rinsing water pipes are staggered; and a plurality of strip-type magnetic sheets are provided with intervals on an inner wall of the permanent magnetic drum, and an extending direction of each of the magnetic sheets is consistent with an axial direction of the permanent magnetic drum.

2. The concentrate extracting and slag reducing magnetic separator according to claim 1, wherein the plurality of rinsing water pipes are concentrically arranged with respect to the permanent magnetic drum.

3. The concentrate extracting and slag reducing magnetic separator according to claim 1, wherein the ore feeding box is a pipe type ore feeding box, the pipe type ore feeding box comprises a pipe body having two closed ends arranged at the ore entering side of the tank, at least one ore feeding port is provided at a top portion of the pipe body, an ore drawing slot is provided at a bottom of the pipe body, an extending direction of the ore drawing slot is consistent with the axial direction of the permanent magnetic drum; a width of a portion, corresponding to the ore feeding port, of the ore drawing slot is slightly less than or equal to widths of other portions of the ore drawing slot.

4. The concentrate extracting and slag reducing magnetic separator according to claim 3, wherein two layers of unloading scraping boards are provided at an upper position and a lower position of an ore unloading side of the concentrate extracting and slag reducing magnetic separator.

5. The concentrate extracting and slag reducing magnetic separator according to claim 2, wherein the ore feeding box is a pipe type ore feeding box, the pipe type ore feeding box comprises a pipe body having two closed ends arranged at the ore entering side of the tank, at least one ore feeding port is provided at a top portion of the pipe body, an ore drawing slot is provided at a bottom of the pipe body, an extending direction of the ore drawing slot is consistent with the axial direction of the permanent magnetic drum; a width of a portion, corresponding to the ore feeding port, of the ore drawing slot is slightly less than or equal to widths of other portions of the ore drawing slot.

6. The concentrate extracting and slag reducing magnetic separator according to claim 5, wherein two layers of unloading scraping boards are provided at an upper position and a lower position of an ore unloading side of the concentrate extracting and slag reducing magnetic separator.

* * * * *